United States Patent [19]

Hamlin

[11] Patent Number: 4,960,119

[45] Date of Patent: Oct. 2, 1990

[54] AIRCRAFT AIRCREW LIFE SUPPORT SYSTEMS

[75] Inventor: Humphrey A. S. Hamlin, Yeovil, United Kingdom

[73] Assignee: Normalair-Garrett (Holdings) Limited, England

[21] Appl. No.: 347,007

[22] Filed: May 4, 1989

[30] Foreign Application Priority Data

May 31, 1988 [GB] United Kingdom ..... 8812888

[51] Int. Cl.[5] ..... A62B 7/14; A62B 7/08; A62B 7/02

[52] U.S. Cl. ..... 128/204.18; 128/201.25; 128/201.28; 128/202.11

[58] Field of Search ..... 128/200.24, 201.28, 128/201.29, 202.11, 202.26, 202.27, 204.18, 201.25

[56] References Cited

U.S. PATENT DOCUMENTS

| | | | |
|---|---|---|---|
| 2,824,557 | 2/1958 | Mejean et al. | 128/202.11 |
| 3,103,927 | 9/1963 | Henneman et al. | 128/201.28 |
| 3,190,287 | 6/1965 | Miller, Jr. | 128/202.11 |
| 3,593,735 | 7/1971 | Reiher | 128/201.28 |
| 3,720,501 | 3/1973 | Cramer et al. | 128/202.26 |
| 4,428,372 | 1/1984 | Beysel et al. | 128/202.26 |
| 4,619,255 | 10/1986 | Spinosa et al. | 128/202.27 |
| 4,651,728 | 3/1987 | Gupta et al. | 128/201.28 |
| 4,870,960 | 10/1989 | Hradek | 128/204.18 |

FOREIGN PATENT DOCUMENTS

| | | | |
|---|---|---|---|
| 0263677 | 4/1988 | European Pat. Off. | 128/202.11 |

*Primary Examiner*—Edgar S. Burr
*Assistant Examiner*—Kimberly L. Asher
*Attorney, Agent, or Firm*—Larson and Taylor

[57] ABSTRACT

Oxygen-enriched breathable gas for breathing by aircrew is delivered by an on-board oxygen generating system 11 utilizing molecular sieve adsorber beds 12. The breathable gas is compressed by a compressor 17 and supplied by way of an appropriately switched two-way valve 25 to a plenum storage tank 30 from which it is withdrawn for breathing by aircrew during normal flight operations. The two-way valve may be switched by electronic control means 15 to connect the compressor with an aircrew seat mounted emergency storage bottle 40 when breathable gas of maximum oxygen concentration is being delivered by the OBOGS and the pressure in the emergency storage bottle is sensed to have fallen below a designated value. This reduces the system servicing requirements and minimizes the size of the system components, in particular the adsorber beds.

8 Claims, 1 Drawing Sheet

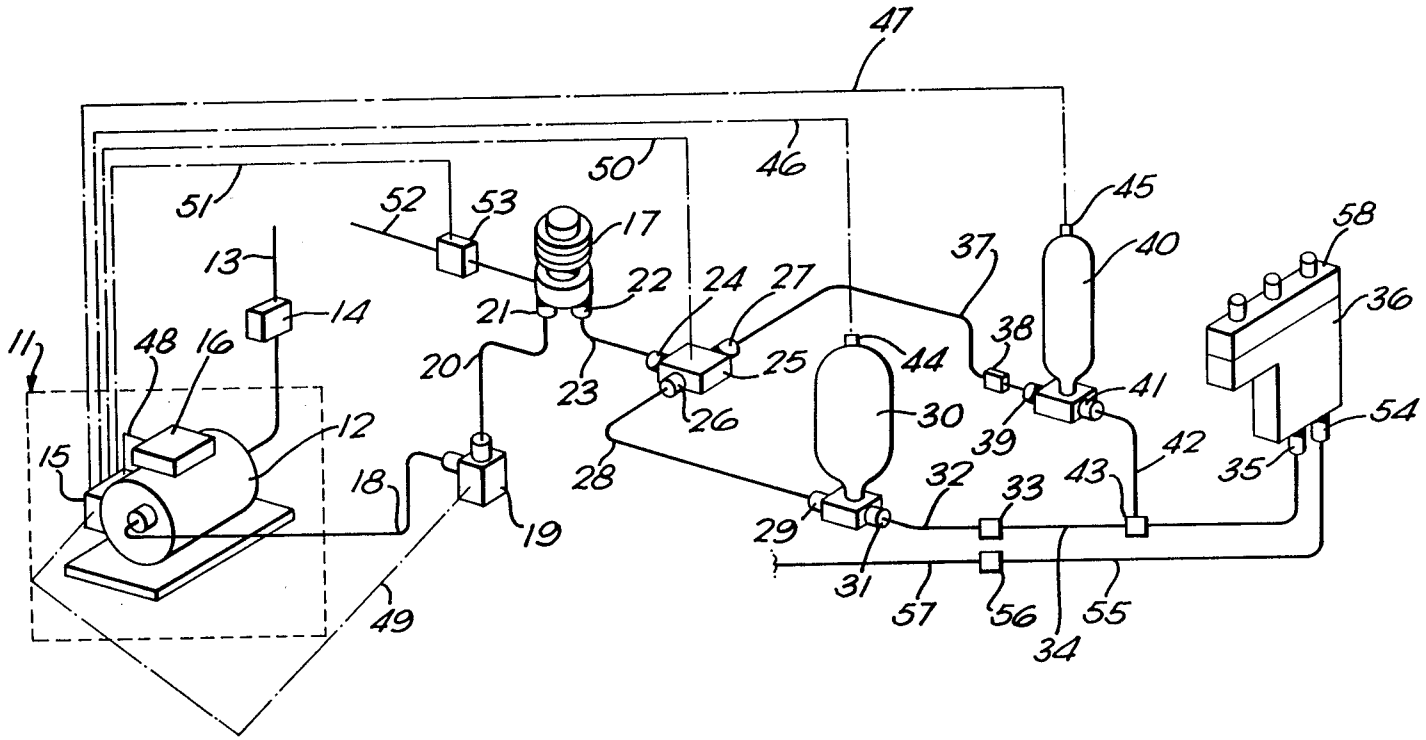
11
12
13
14
15
16
17
18
19
20
21
22
23
24
25
26
27
28
29
30
31
32
33
34
35
36
37
38
39
40
41
42
43
44
45
46
47
48
49
50
51
52
53
54
55
56
57
58

AIRCRAFT AIRCREW LIFE SUPPORT SYSTEMS

BACKGROUND OF THE INVENTION

1. Field of the Invention

This invention relates to aircraft aircrew life support systems and is more particularly concerned with a system which includes an aircraft on-board oxygen generating system for delivering oxygenenriched breathable gas.

2. Description of the Prior Art

On-board oxygen generating systems (OBOGS) utilising molecular sieve adsorber beds have been demonstrated to be advantageous to the safety and operation of a wide range of military aircraft. As a result it is now common practice in aircrew life support systems to supply oxygen-enriched breathable gas to the aircrew from an OBOGS.

In some systems breathable gas delivered by the OBOGS is supplied by way of a breathing demand regulator to a face mask worn by an aircrew member so that effectively he is breathing gas direct from the OBOGS. In such systems breathable gas flow from the OBOGS must be such as to cope with peaks in breathing demand. This may require flows as high as 200 liters/minute so that the molecular sieve beds of the OBOGS must be of considerable volume making greater demands on the space required for housing the OBOGS within the aircraft.

Also, it is usual for the OBOGS to derive its supply air from a bleed of aircraft engine compressor air so that it is operational only when the engine is running. This gives rise to a requirement that provision be made to store breathable gas on the aircraft for use by an aircrew member when he is sitting in his aircraft on the ground before engine start-up or after engine shut-down, or in the event of failure of the supply of compressed air.

Systems have been proposed which incorporate a plenum storage tank charged with breathable gas delivered by the OBOGS at the operating pressure of the system. Whilst this is a solution, it can be shown that the minimum requirement is in the order of 600 liters of stored breathable gas at normal temperature and pressure which requires a large volume storage tank be housed within the aircraft.

It is also necessary for breathable gas to be supplied to the aircrew member during bail-out from the aircraft in the event of an emergency. This requirement is normally met by providing a pressurised breathable gas bottle, normally containing 100% oxygen, mounted on the aircrew seat which gives rise to an additional servicing task.

US-A-4428372 (issued to Linde and now assigned to the present applicant) discloses an aircraft aircrew breathing system in which a portion of oxygen-enriched breathable gas delivered from molecular sieve adsorber beds of an OBOGS is stored in an emergency storage tank for use in the event of an interruption of the normal supply of breathable gas from the adsorbers. Whilst the emergency storage tank provides a back-up supply of breathable gas for use by aircrew within the aircraft, the provision of breathable gas to the aircrew during bail-out from the aircraft is neither disclosed or discussed.

US-A-4651728 (Boeing) discloses an aircraft aircrew breathing system which includes an OBOGS for supplying oxygen-enriched breathable gas for breathing by aircrew. This system has a standby supply of breathable gas and an emergency supply of breathable gas stored in separate cylinders. A selector valve is provided whereby breathable gas may be withdrawn from the standby cylinder for breathing by aircrew when the aircraft is on the ground with the OBOGS non-operational or during flight if the OBOGS malfunctions. The emergency breathable gas cylinder is included primarily as a source of breathable gas for use by the aircrew during bail-out from the aircraft but may also be used in the event of failure of both the OBOGS and the standby cylinder.

In one system embodiment disclosed in US-A-4651728 the standby cylinder is charged with oxygen-enriched breathable gas delivered by the OBOGS. Gas pressure in the storage cylinder is sensed and when it falls below a designated value the OBOGS is switched to produce breathable gas of high oxygen concentration which is compressed by a compressor before being fed to the storage cylinder. When the storage cylinder has been recharged to a preselected pressure the OBOGS returns to its normal operation and the compressor is switched off.

There is no disclosure in US-A-4651728 as to the method by which the emergency breathable gas cylinder is charged. In the absence of any disclosure to the contrary it must be assumed that the emergency cylinder is charged externally of the aircraft with 100% oxygen gas under pressure in the manner of conventional emergency oxygen bottles used on aircraft at the present time.

A disadvantage of both the systems disclosed in US-A-4428372 and US-A-4651728 is that in normal operation oxygen-enriched breathable gas is supplied direct from the OBOGS to the aircrew with the standby or emergency gas sources being used only in the event that the OBOGS is non-operational or malfunctioning. This gives rise to the requirement that the molecular sieve beds of the OBOGS be sized to cope with peaks in aircrew breathing demand thereby increasing the space envelope required for housing the OBOGS in the aircraft.

SUMMARY OF THE INVENTION

It is an object of the present invention to provide an aircraft aircrew life support system including an OBOGS which minimises the size of the system components and the servicing requirements of the system.

In the present invention this object is met by an aircraft aircrew life support system comprising an on-board oxygen generating system (OBOGS) for delivering oxygen-enriched breathable gas, compressor means connected for receiving breathable gas delivered by the OBOGS and operable to increase the pressure of said breathable gas. A plenum storage tank and an emergency storage bottle are each connected for receiving breathable gas at increased pressure from the compressor means. Flow of breathable gas from the compressor means to either one or the other of the plenum storage tank or emergency storage bottle is controlled by valve means. Switching of the valve means is controlled by control means which ensure that breathable gas of appropriate oxygen concentration is delivered to whichever one of storage tank or storage bottle requires to be charged. During normal aircraft flight operations breathable gas for breathing by aircrew is supplied from the storage tank and in emergency situations, such as bail-out from the aircraft, breathable gas for breathing by aircrew is supplied from the emergency storage bottle.

The control means, which may comprise an electronic control unit (ECU), are connected for receiving signals from means sensing breathable gas pressure internally of the plenum storage tank and the emergency storage bottle, and are further connected for receiving signals from gas concentration sensing means sensing concentrations of oxygen in breathable gas delivered by the OBOGS and for outputting signals for control of the valve means.

The OBOGS and the compressor means may be sized to provide breathable gas at a rate just exceeding the average consumption rate; the peak flow requirements being satisfied by the stored capacity. By this means a significant reduction in peak gas generation requirements is obtained in relation to systems in which the OBOGS supplies all normal operational gas requirements.

Thus, in operation of a system in accordance with one embodiment of the invention, the control means is adapted to control the OBOGS and the compressor means to run continuously in supplying breathable gas to the storage tank and to switch the valve means to connect the compressor means with the storage bottle only when pressure sensing means sense that gas pressure in the storage bottle has fallen below a designated value. The gas pressure in the storage tank is chosen to be adequate to meet the immediate needs of the aircrew member and the concentration of oxygen in the breathable gas delivered by the OBOGS is controlled to be appropriate for charging the storage bottle at least while this is being charged.

In operation of a system in accordance with another embodiment of the invention the control means is adapted to control the OBOGS to run continuously and to commence operation of the compressor means only when pressure sensing means sense that the pressure in either the storage tank or storage bottle has fallen below a designated value, the valve means being switched by the control means to connect the compressor means with the appropriate one of the storage tank or the storage bottle.

In operation of a system in accordance with a further embodiment of the invention the control means is adapted to control both the OBOGS and the compressor means to commence operation only when it is required to supply breathable gas to either one of the storage tank or storage bottle and to switch the valve means to connect the compressor means to whichever of the storage tank or storage bottle requires to be charged.

The control means may be further adapted to control cycling of the OBOGS molecular sieve adsorber beds whereby breathable gas of oxygen concentration appropriate to charging either the storage tank or the storage bottle is delivered by the OBOGS.

Breathable gas supplied from the OBOGS to the storage bottle must be of maximum oxygen concentration, usually between 90% and 95% oxygen; however, a system in accordance with the present invention may also supply breathable gas of maximum oxygen concentration to the storage tank, over oxygenation of the aircrew member in breathing from the storage tank being prevented by a breathable gas delivery regulator of airmix type which mixes aircraft cabin air with breathable gas from the storage tank before it is supplied to a face mask worn by the aircrew member.

Protection of the aircrew member against chemical warfare agents is enhanced if those agents are not permitted to enter the breathable gas delivery system. A system which uses an air mix regulator reduces the ability of the system to give protection in a chemical warfare environment. Where such chemical warfare protection is a requirement of an aircrew life support system the regulator may be of a type which supplies 100% OBOGS derived breathable gas, i.e. with no ambient cabin air dilution. In such a system the OBOGS may deliver breathable gas of maximum oxygen concentration, i.e. 90% oxygen or more, for supply to the storage bottle, and breathable gas of 55% to 60% oxygen concentration which is suitable for breathing from ground level to a maximum aircraft cabin operating altitude of 6100 meters (20000 feet), i.e. from ground level to maximum aircraft operating altitude of 18300 meters (60000 feet) with a pressurised cabin, to the storage tank.

In one such system in accordance with the present invention, the control means is adapted to control cycling of the OBOGS molecular sieve adsorber beds so that breathable gas of maximum oxygen concentration, i.e. 90% or more, is delivered when it is required to charge the storage bottle and breathable gas of oxygen concentration in a required range, i.e. 55% to 60%, is delivered when the storage tank is being charged. During normal flight operation the aircrew member draws breathable gas from the storage tank by way of his breathing regulator which does not have provision for airmix. In an emergency, such as cabin decompression or ejection of the aircrew member from his aircraft, means are provided for automatically switching the storage bottle to supply breathable gas to the regulator. Manually operated means may also be provided to permit the aircrew member to override the system in obtaining breathable gas from the storage bottle.

The compressor means, which may be single or multi-stage, may be driven by pneumatic, electric or hydraulic means.

BRIEF DESCRIPTION OF THE DRAWINGS

The invention will now be further described by way of example only and with reference to the accompanying drawing which shows an aircraft aircrew life support system including an aircraft on-board oxygen generating system (OBOGS) in accordance with one embodiment of the invention.

DETAILED DESCRIPTION OF THE DRAWINGS

Referring to the drawing, an aircraft aircrew life support system 10 includes an aircraft on-board oxygen generating system (OBOGS) 11 utilising molecular sieve adsorber beds for delivering oxygen-enriched breathable gas. The OBOGS 11 comprises a molecular sieve adsorber bed container 12 providing a plurality of concentric molecular sieve beds (not shown) as disclosed in EP-A-0225736 (Normalair Garrett). The sieve beds are filled with molecular sieve material having an affinity for retaining nitrogen whilst allowing oxygen to pass and are supplied with air bled from a compressor stage of an engine (not shown) of the aircraft by way of a supply line 13 incorporating a pressure reducing valve 14. The sieve beds are cycled through onstream adsorption and offstream desorption phases by control means comprising an electronic control unit (ECU) 15 which may include a microprocessor (not shown), operating in known manner. The concentration of oxygen in breathable gas delivered by the OBOGS is monitored by gas sensor means which in this embodiment comprises an oxygen partial pressure sensor 16 such as is disclosed in EP-A-0036285 (Normalair-Garrett) but which may be of any other suitable type. Signals from the sensor 16 are fed to the ECU 15 for control of bed cycling.

The system 10 further includes compressor means which in this embodiment comprises a pneumatically driven gas compressor 17. The drive mechanism (not shown) of the compressor 17 receives pressurised air by way of a supply line 52 in which is positioned a flow control valve 53. The compressor 17 receives oxygen-enriched breathable gas delivered by the OBOGS 12 by way of a supply line 18, an oxygen concentration monitor 19, a supply line 20, and a compressor inlet 21. The oxygen concentration monitor 19 may be an oxygen partial pressure sensor such as is disclosed in EP-A-0036285 or any other suitable type, and supplies signals to the ECU 15 in addition to the signals from the sensor 16, for back-up and safety purposes. An outlet 22 of the compressor 17 is joined by a supply line 23 with an inlet 24 of a two-way valve 25 having outlets 26 and 27.

One outlet 26 of the two-way valve 25 is joined by a supply line 28 with an inlet valve 29 of a breathable gas plenum storage tank 30. A pressure reducing outlet valve 31 of the storage tank 30 is joined by a supply line 32, a quick disconnect coupling 33 and a supply line 34 to an inlet connector 35 of a breathable gas delivery regulator 36 which may be mounted on an aircrew seat (not shown).

The other outlet 27 of the two-way valve 25 is joined by a supply line 37 and a quick disconnect coupling 38 to an inlet valve 39 of an emergency breathable gas storage bottle 40 adapted for mounting on the aircrew seat (not shown). A pressure reducing outlet valve 41 of the gas storage bottle 40 is connected with the supply line 34 by a supply line 42 and a connector 43.

The gas storage tank 30 and gas storage bottle 40 are provided with pressure transducers 44 and 45, respectively, for sensing the pressure of the gas stored therein. The transducers 44 and 45 are connected by signal lines 46 and 47, respectively, with the ECU 15. The ECU 15 is also connected for receiving signals from the oxygen partial pressure sensor 16 and the oxygen monitor 19 by way of signal lines 48 and 49, respectively.

The ECU 15 is further connected by a signal line 50 to the two-way valve 25 and by a signal line 51 to the flow control valve 53 in the compressed air supply line 52 connected to the drive mechanism (not shown) of the compressor 17.

The breathable gas delivery regulator 36 is of the form which demands 100% system gas without a requirement for addition of aircraft cabin air such as is disclosed in EP-A-0263677 (Normalair-Garrett). In addition to the connector 35 the regulator 36 has an inlet connector 54 which is joined by a supply line 55, quick disconnect coupling 56 and supply line 57, with a source of clean filtered air such as that supplied to the OBOGS 11 by the supply line 13.

The clean filtered air is supplied by way of a valve (not shown) which is integral with the regulator, for inflation of a G protection garment (not shown) worn by the aircrew member. The regulator also incorporates modules (not shown) for providing positive pressure breathing above a predetermined altitude and when the aircrew member is experiencing high G loads. The regulator is adapted for connection to a personal equipment connector 58 carried by the aircrew member and joined by supply lines (not shown) to his breathing mask and G protection garment.

Let it be assumed that on commencement of operation of the system 10 the storage tank 30 and storage bottle 40 are fully charged with oxygen-enriched breathing gas. The aircrew member draws breathable gas from the storage tank 30 by way of the breathing regulator 36. When the pressure of the breathable gas in the storage tank 30 falls to a predetermined value the pressure transducer 44 signals the ECU 15 to commence operation of the OBOGS 11. The ECU controls cycling of the sieve beds such that the concentration of oxygen in breathable gas delivered by the OBOGS is in the range 55% to 60% oxygen, the concentration of oxygen being monitored by the oxygen partial pressure sensor 16 which outputs signals to the ECU for control of bed cycling. At the same time the ECU signals the flow control valve 53 to commence operation of the compressor 17 whereby the breathable gas delivered by the OBOGS is further compressed before passing into the storage tank 30 by way of the two-way valve 25 which is also signalled by the ECU to direct gas to flow to the storage tank whilst closing connection with the supply line 37 to the storage bottle. Operation of the OBOGS continues until the gas pressure in the storage tank reaches a predetermined maximum whereupon the ECU is signalled to shut down the OBOGS and the compressor.

Should for any reason the pressure of the breathable gas in the storage bottle 40 fall below a predetermined value then the pressure transducer 45 outputs a signal to the ECU. If the pressure in the storage tank 30 is above the required minimum value and the storage tank is not being charged the ECU commences operation of the OBOGS and controls cycling of the sieve beds so as to produce breathable gas having an oxygen concentration of 90% or more. The ECU also signals the flow control valve 53 to commence operation of the compressor 17. When the ECU receives signals from both the oxygen partial pressure sensor 16 and the oxygen monitor 19 to the effect that the oxygen concentration in the breathable gas is 90% or more, it signals the two-way valve 25 to direct gas to flow to the storage bottle 40 whilst closing connection with the supply line 28 to the storage tank 30.

The system is also provided with a manually operated lever (not shown) which permits the aircrew member to override the system and breathe gas from the storage bottle in the event of an emergency such as a malfunction causing cessation of the supply of breathable gas from the storage tank.

Altitude sensitive means, such as an aneroid operated valve (not shown), is also provided with the storage bottle 40 for switching the bottle to deliver breathable gas to the breathing regulator 36 in the event of cabin decompression above 6100 meters.

Also provided with the storage bottle 40 is a mechanical switching means (not shown) which is operated to connect the bottle to the regulator on ejection of the aircrew member from his aircraft so that he is supplied with breathable gas both during and after ejection.

In the embodiment of the invention hereinbefore described with reference to the accompanying drawing the OBOGS 11 and compressor 17 are signalled by the ECU 15 to commence operating only when there is a requirement to charge one or other of the storage tank or storage bottle.

In an alternative embodiment of the invention the OBOGS may operate continuously under the control of the ECU with the compressor being signalled to commence operating only when there is a requirement to charge either one of the storage tank or storage bottle because the pressure therein has fallen below the predetermined minimum value.

In a further embodiment of the invention both the OBOGS and the compressor may operate continuously in charging the storage tank with the OBOGS being controlled to produce breathable gas suitable for charging the storage bottle and the two-way valve being switched to deliver such gas to the storage bottle when the pressure therein is sensed as having fallen below a predetermined minimum value. Such a system is particularly suited for meeting a requirement where there is a large demand on the storage tank such as is the case in an aircraft having two or more aircrew members. It will be appreciated that in a system meeting such a requirement a storage bottle will be provided for each aircrew member.

In yet another embodiment of the invention the OBOGS is operated always to produce gas of maximum oxygen concentration which after compression by the compressor is delivered to charge either the storage tank or storage bottle, as is appropriate. Gas withdrawn from the storage tank is mixed with cabin air at the regulator to provide breathable gas having an oxygen concentration appropriate to the requirements of the aircrew member.

What is claimed is,

1. An aircraft aircrew life support system comprising an on-board oxygen generating system (OBOGS 11) for delivering oxygen-enriched breathable gas, compressor means (17) connected for receiving breathable gas delivered by the OBOGS and operable to increase the pressure of said breathable gas, a plenum storage tank (30) connected for receiving breathable gas from said compressor means and further connected for supplying breathable gas for breathing by aircrew during normal flight operations, an emergency breathable gas storage bottle (40) connected for receiving breathable gas from said compressor means and further connected for supplying breathable gas for breathing by aircrew at least during bail-out from the aircraft, valve means (25) connected between said compressor means and said storage tank and storage bottle, said valve means being operable by control means (15) to selectively control breathable gas to flow from the compressor means to charge either the plenum storage tank or the emergency storage bottle.

2. An aircraft aircrew life support system as claimed in claim 1, wherein the control means (15) is connected for receiving signals from means (44, 45) sensing breathable gas pressure internally of the plenum storage tank (30) and the emergency storage bottle (40), and is further connected for receiving signals from gas concentration sensor means (16, 19) sensing concentrations of oxygen in breathable gas delivered by the OBOGS (11) and for outputting signals for control of the valve means (25).

3. An aircraft aircrew life support system as claimed in claim 2, wherein the control means (15) is adapted to control the OBOGS (11) and the compressor means (17) to operate continuously with the valve means (25) switched to connect the compressor means with the plenum storage tank (30) and to switch the valve means to connect the compressor means with the emergency storage bottle (40) when breathable gas pressure in said bottle has fallen below a designated value and breathable gas of appropriate oxygen concentration is being delivered by the OBOGS.

4. An aircraft aircrew life support system as claimed in claim 2, wherein the control means (15) is adapted to control the OBOGS (11) to run continuously and to commence operation of the compressor means (17) when the pressure sensing means (44, 45) sense that the pressure in either of said storage tank (30) or said storage bottle (40) has fallen below a designated value.

5. An aircraft aircrew life support system as claimed in claim 2, wherein the control means (15) is adapted to control the OBOGS (11) and the compressor means (17) to commence operation when the pressure sensing means (44, 45) sense that the pressure in either one of said storage tank (30) or said storage bottle (40) has fallen below a designated value.

6. An aircraft aircrew life support system as claimed in claim 1, wherein the control means (15) is adapted to control cycling of OBOGS molecular sieve adsorber beds (12) whereby breathable gas of oxygen concentration appropriate to charging either said storage tank (30) or said storage bottle (40) is delivered by the OBOGS.

7. An aircraft aircrew life support system as claimed in claim 1, further comprising a breathable gas delivery regulator (36) connected for receiving breathable gas from the storage tank (30) or the storage bottle (40).

8. An aircraft aircrew life support system as claimed in claim 7, wherein the regulator (36) is adapted to deliver undiluted breathable gas supplied from the storage tank (30) or storage bottle (40) and that the OBOGS (11) is controlled to deliver breathable gas of maximum oxygen concentration for charging the storage bottle and breathable gas of oxygen concentration in a range suitable for breathing from ground level to a maximum aircraft cabin operating altitude for charging the storage tank.

* * * * *